US010604377B2

(12) United States Patent
Liang

(10) Patent No.: US 10,604,377 B2
(45) Date of Patent: Mar. 31, 2020

(54) HOSE STORAGE DEVICE

(71) Applicant: Newbud Industrial Corp., Chang Hua Hsien (TW)

(72) Inventor: Tsang-Fu Liang, Chang Hua Hsien (TW)

(73) Assignee: Newbud Industrial Corp., Chang Hua Hsien (TW)

( * ) Notice: Subject to any disclaimer, the term of this patent is extended or adjusted under 35 U.S.C. 154(b) by 112 days.

(21) Appl. No.: 15/893,664

(22) Filed: Feb. 11, 2018

(65) Prior Publication Data

US 2019/0071278 A1 Mar. 7, 2019

(30) Foreign Application Priority Data

Sep. 6, 2017 (TW) ..... 106130461 A

(51) Int. Cl.

| | |
|---|---|
| ***B65H 75/28*** | (2006.01) |
| ***B65H 75/24*** | (2006.01) |
| ***B65H 75/26*** | (2006.01) |
| ***B65H 75/12*** | (2006.01) |

(52) U.S. Cl.

CPC ..... *B65H 75/241* (2013.01); *B65H 75/12* (2013.01); *B65H 75/265* (2013.01); *B65H 75/28* (2013.01); *B65H 2701/33* (2013.01)

(58) Field of Classification Search

CPC ..... B65H 75/12; B65H 75/28; B65H 75/241; B65H 75/265

See application file for complete search history.

(56) References Cited

U.S. PATENT DOCUMENTS

| | | | | | |
|---|---|---|---|---|---|
| 3,297,194 | A * | 1/1967 | Caldwell | B65D 1/10 | 220/672 |
| 4,354,645 | A * | 10/1982 | Glavas | B65H 75/22 | 242/602.2 |
| 5,246,184 | A * | 9/1993 | Trewhella, Jr. | B65H 75/18 | 242/125.1 |
| 5,957,401 | A * | 9/1999 | O'Donnell | B65H 75/406 | 191/12.4 |
| 6,676,069 | B1 * | 1/2004 | Davis | B65H 75/146 | 242/405.2 |
| 6,918,557 | B2 * | 7/2005 | Ast | B65H 75/146 | 242/388.6 |
| 7,017,743 | B1 * | 3/2006 | Patterson | B65D 11/02 | 206/408 |
| 9,478,963 | B1 * | 10/2016 | Klein | H02G 11/02 | |

* cited by examiner

*Primary Examiner* — Sang K Kim

(57) ABSTRACT

A retractable hose storage device has: a base, a cylinder and an upper cover. The base has a plurality of through apertures and at least one assembling protrusion around the through apertures. The cylinder has a container perpendicularly jacketed onto the assembling protrusion of the base, and at least one upper opening and one lower opening. The upper cover has an assembling ring correspondingly disposed with the cylinder and a plurality of hanging holes.

12 Claims, 10 Drawing Sheets

HOSE STORAGE DEVICE

BACKGROUND OF THE INVENTION

1. Field of the Invention

The present invention relates to a hose storage device, and more particularly to retractable hose storage device.

2. Description of the Related Art

General water hose is a very convenient tool, especially to transport the liquid in ordinary daily life such as gardening irrigation or car washing. However, most of the hoses are manually storage, but unwinding the hose by hand is prone to bending of the hoses, which causes to deformation. When the hose is more than 10 meters in length, storage is very inconvenient, laborious and time-consuming. Therefore, a hose winding rack is currently on the market, which utilizes a handle to scrolls a storage cylinder, so that the hose can be gradually rolled up and collected around storage cylinder. However, the storage system is arranged laterally by the storage tube system, resulting in the water remaining in the hose being unable to be discharged, thereby causing the hose to suffer from deterioration and damage due to long-term storage.

In addition, a retractable water hose, the extension of hose comes when water passes through and it retracts when the water is turned off. However, usually some remaining water stays in the hose and cannot really be discharged. Since the retractable water hose is made of flexible rubber or flexible plastic material composition, long-term accumulation of moisture and sunlight exposure lead to aging, oxidation and deterioration, thus accelerating the shortening of the life of the retractable water hose.

Therefore, it is desirable to provide a retractable hose storage device to mitigate and/or obviate the aforementioned problems.

SUMMARY OF INVENTION

An objective of present invention is to provide a retractable hose storage device which is capable of improving the above-mention problems.

In order to achieve the above mentioned objective, a retractable hose storage device has: a base, a cylinder and an upper cover. The base has a plurality of through apertures and at least one assembling protrusion around the through apertures. The cylinder has a container perpendicularly jacketed onto the assembling protrusion of the base, and at least one upper opening and one lower opening. The upper cover has an assembling ring correspondingly disposed with the cylinder and a plurality of hanging holes.

Other objects, advantages, and novel features of invention will become more apparent from the following detailed description when taken in conjunction with the accompanying drawings.

DETAILED DESCRIPTION OF PREFERRED EMBODIMENT

Figure 1:
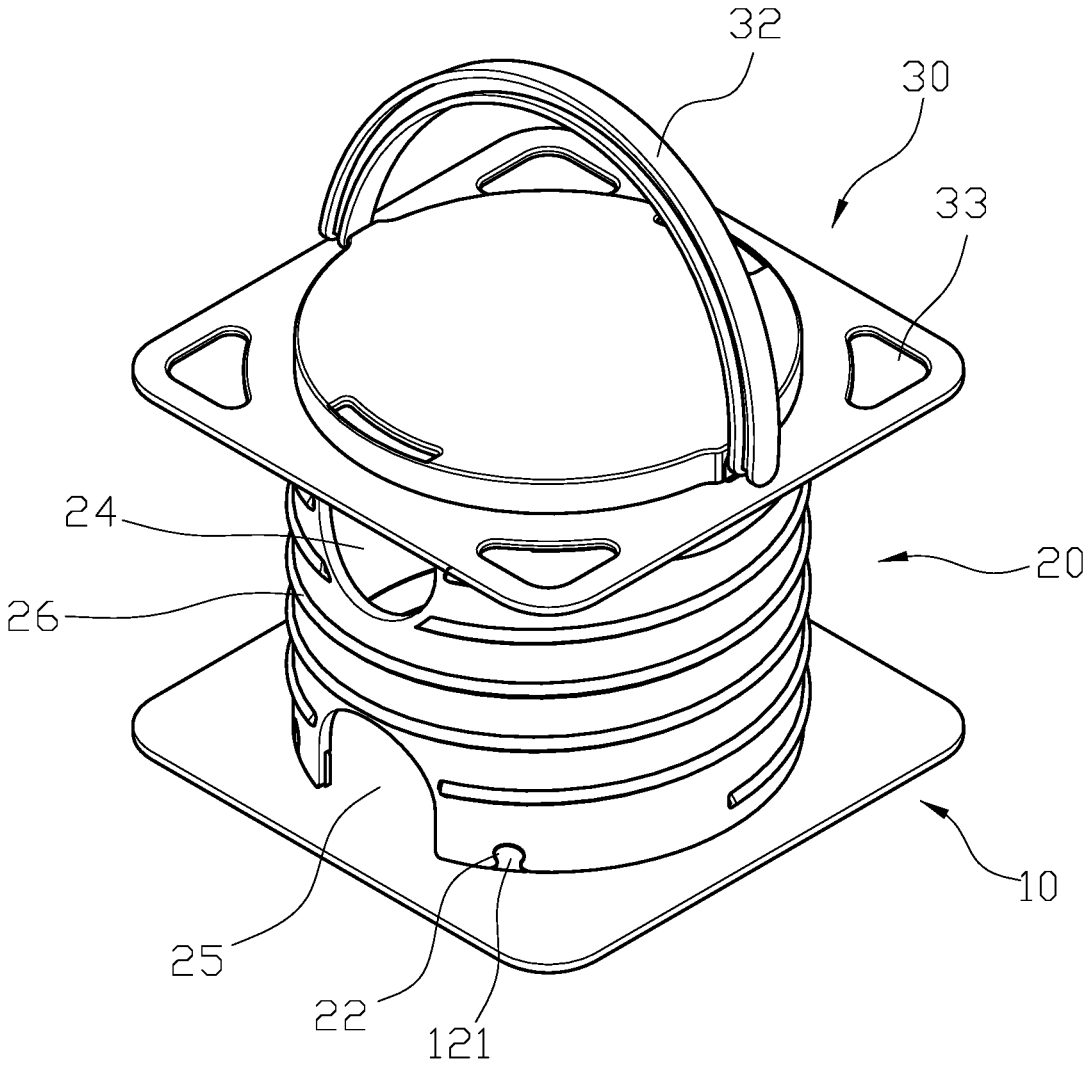
FIG. 1 is a perspective view of an embodiment according to the present invention.

First, please refer to FIG. 1 to FIG. 6. A retractable hose storage device comprising: a base 10, a cylinder 20 and an upper cover 30. The base 10 has a plurality of through apertures 11 and an assembling protrusion 12 around the through aperture 11. The assembling protrusion 12 of the base 10 is a circular strip or a plurality of symmetrically arced strips. In a preferred embodiment, the assembling protrusion 12 is configured of two symmetrically arced strips. A plurality of first engaging tabs 121 are disposed on an outer surface of the assembling protrusion 12. A plurality of supporting feet 13 are disposed on a bottom of the base 10. The cylinder 20 has a container 21 perpendicularly jacketed onto the assembling protrusion 12 of the base 10. The bottom of the cylinder is provided with a plurality of first engaging holes 22 correspondingly engaging with the plurality of first engaging tabs 121. The cylinder 20 is further provided with an assembly portion 23 on a top thereof, and the assembly portion 23 has at least two positioning grooves 231. The cylinder further comprises two opposing upper openings 24 and two opposing lower openings 25, and circular limiting ribs 26 are disposed around an outer sidewall of the cylinder 20. The upper cover 30 has an assembling ring 31 correspondingly covering the assembly portion 23 of the cylinder 20, and the assembling ring 31 has two opposing positioning ribs 311. Moreover, the upper cover 30 further has a handle 32 and a plurality of hanging holes 33.

Figure 2:
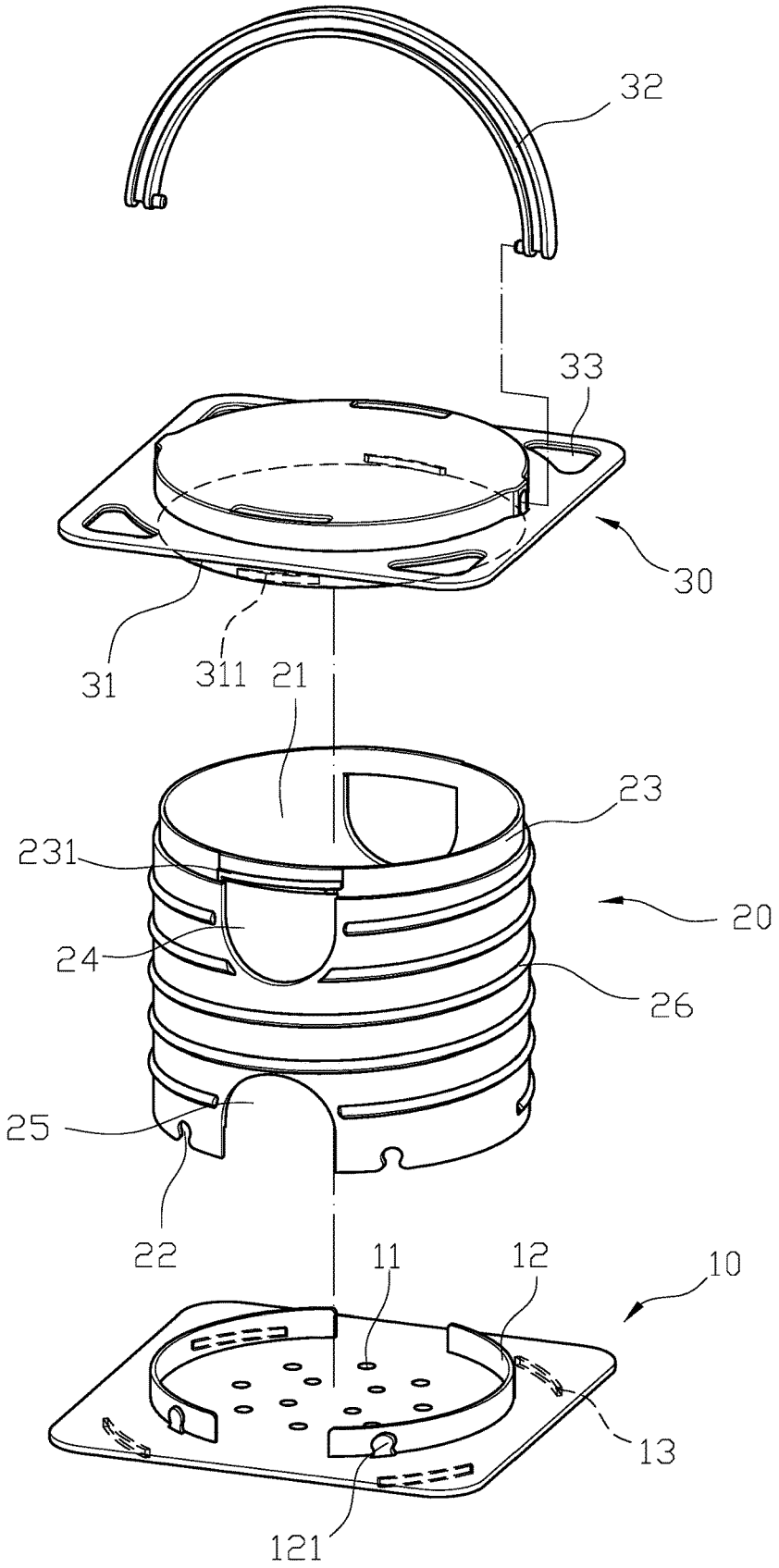
FIG. 2 is an exploded view of the embodiment according to the present invention.
Figure 3:
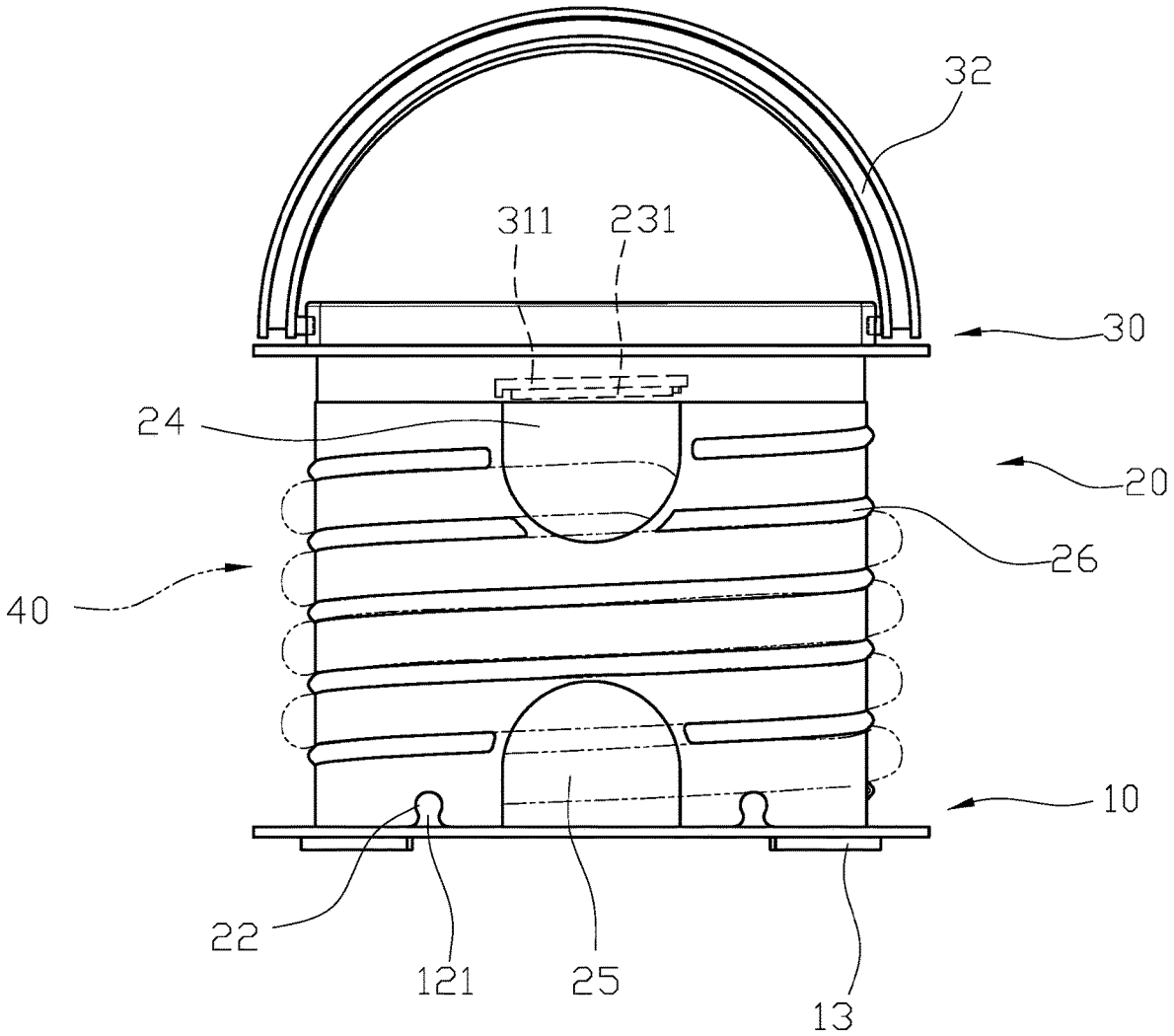
FIG. 3 is a front view of the combination of the present invention and a telescopic hose winding within.

For assembly, please refer to FIG. 1 to FIG. 3. The cylinder 20 jackets onto the assembling protrusion 12 of the base 10, and the plurality of first engaging hole 22 engage with the plurality of first engaging tabs 121 on the assembling protrusion 12. The lower opening 25 on the cylinder 20 are opened to a gap between the assembling protrusion 12. The upper cover 30 utilizes the assembling ring 31 to cover the assembly portion 23 of the cylinder 20, and by rotating the upper cover 30, the positioning rib 311 engages with the positioning groove 231.

Figure 4:
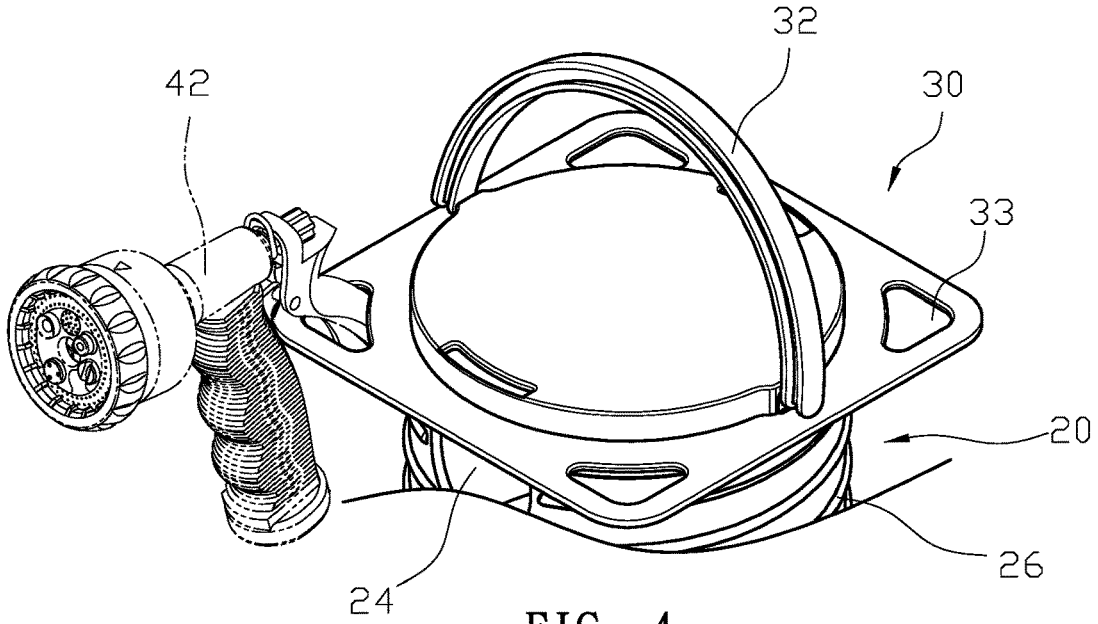
FIG. 4 shows a spray gun hanging out according to the present invention.
Figure 5:
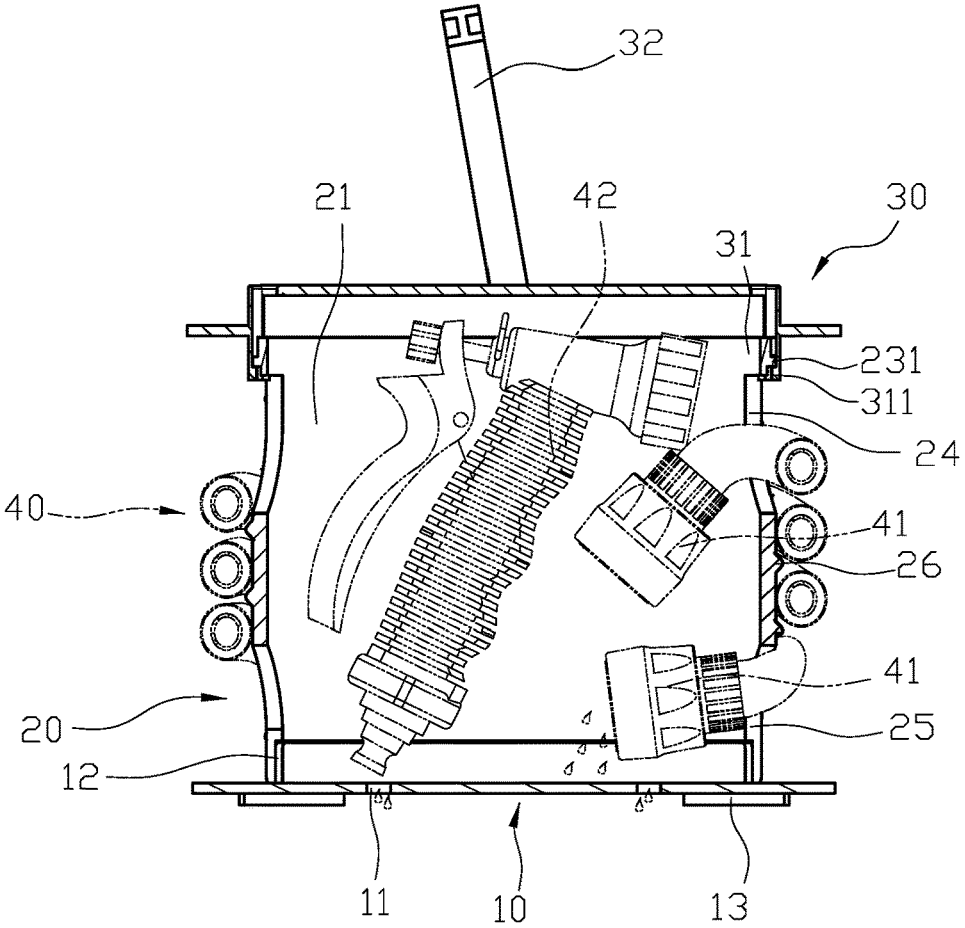
FIG. 5 is a cross-sectional view of the actual use of the embodiment according to the present invention.
Figure 6:
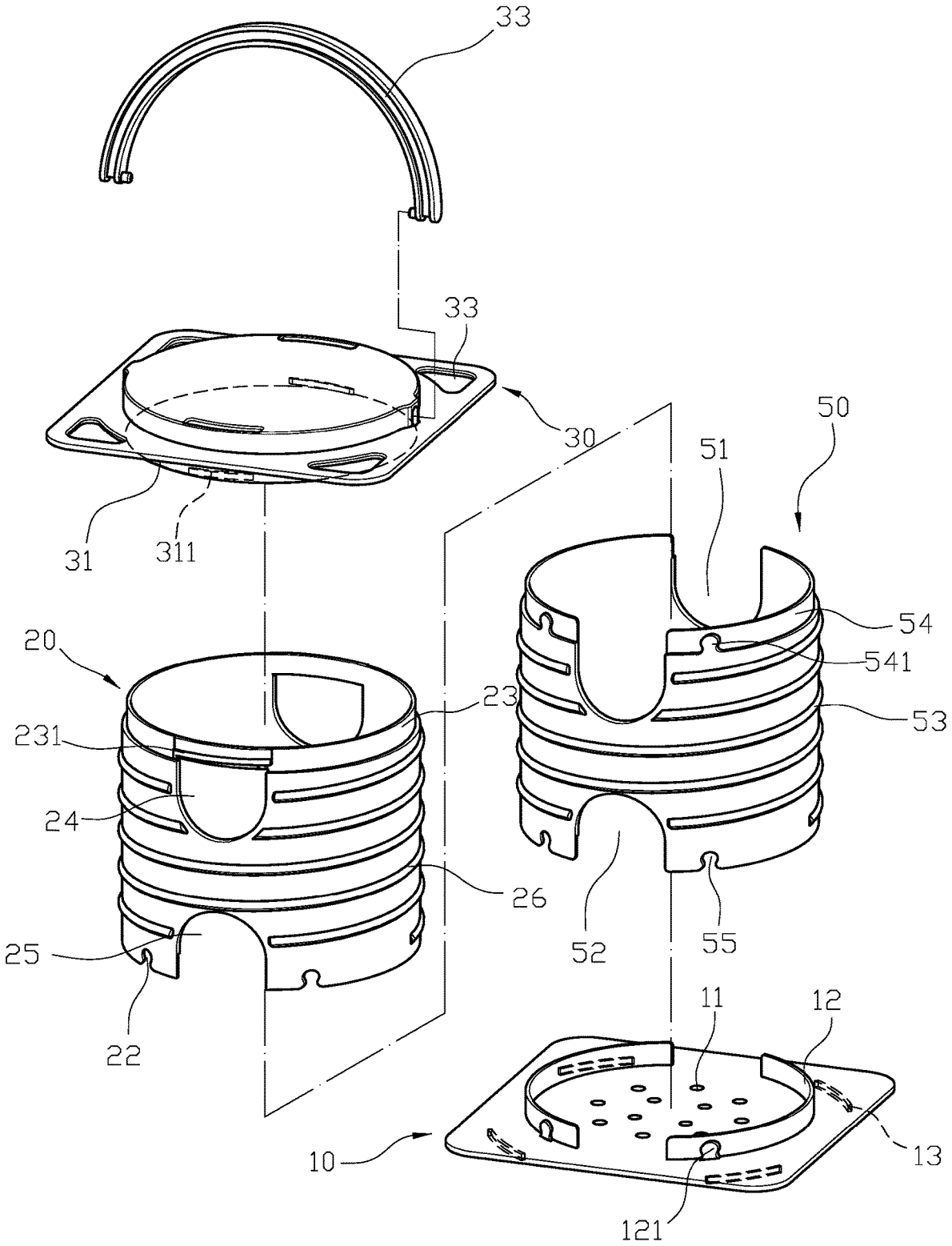
FIG. 6 is an exploded view of an external sleeve attached to another embodiment according the present invention.
Figure 7:
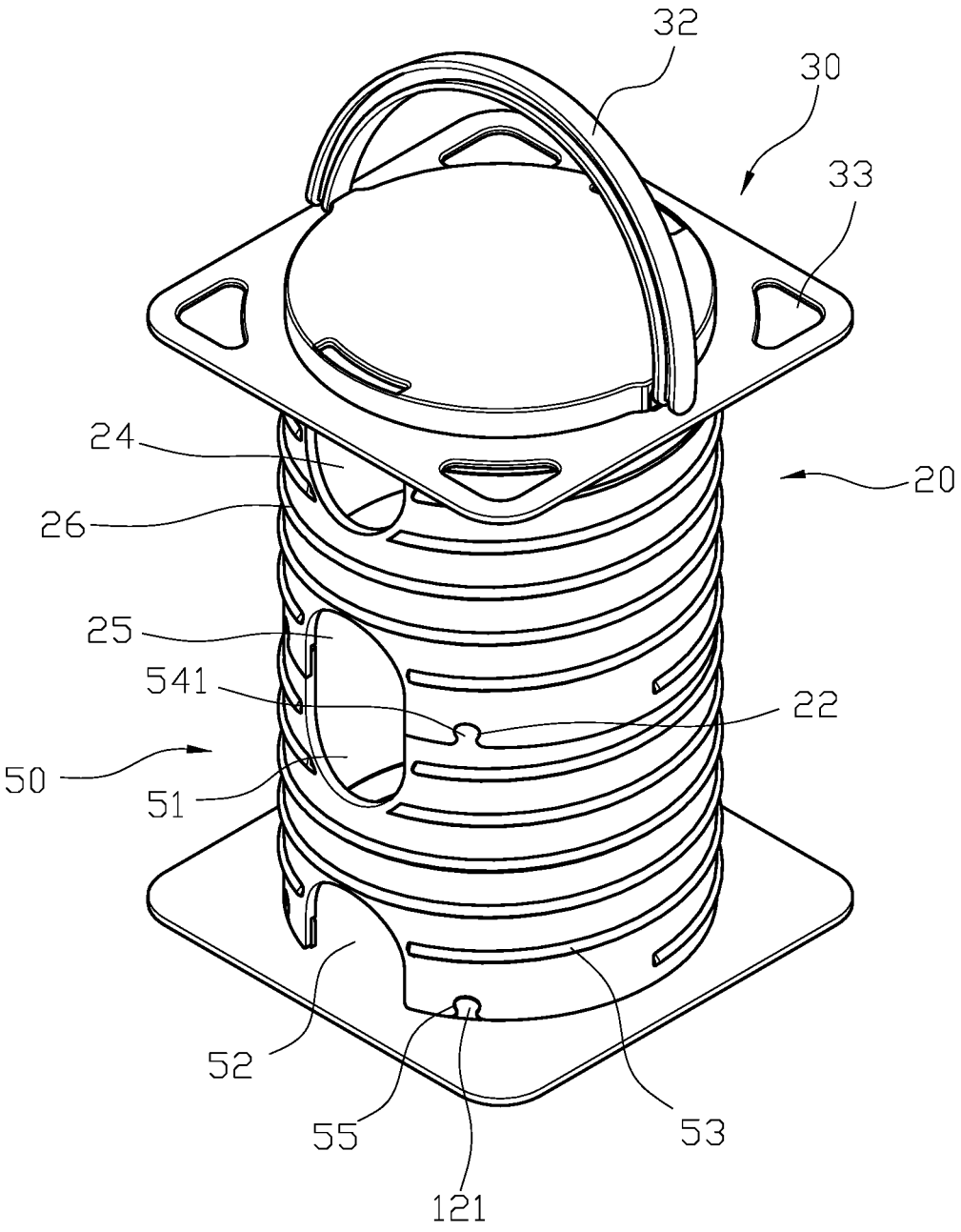
FIG. 7 is a perspective view of an external sleeve attached to another embodiment of the present invention.
Figure 8:
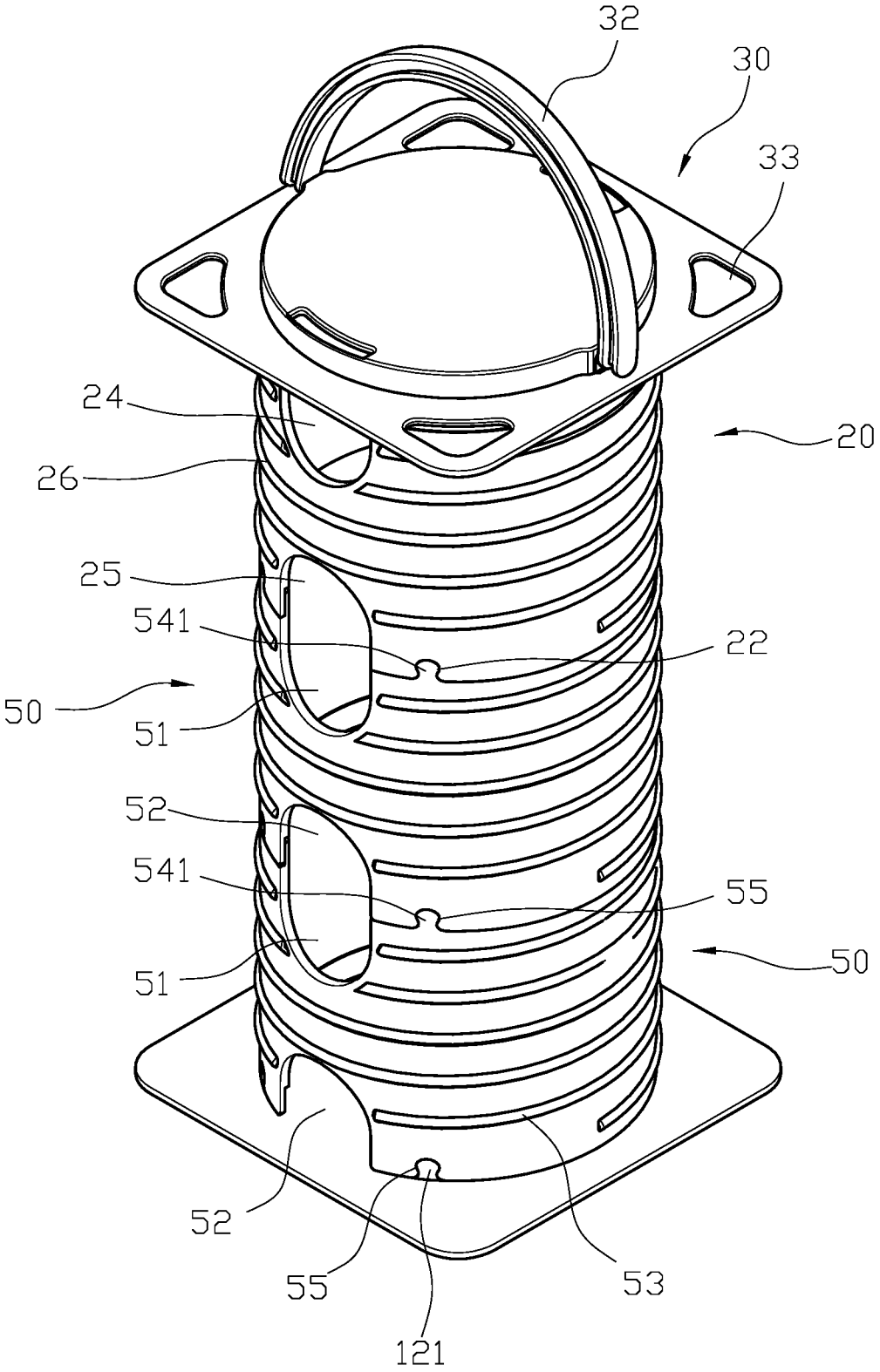
FIG. 8 is a perspective view of two external sleeves attached to another embodiment of the present invention.
Figure 9:
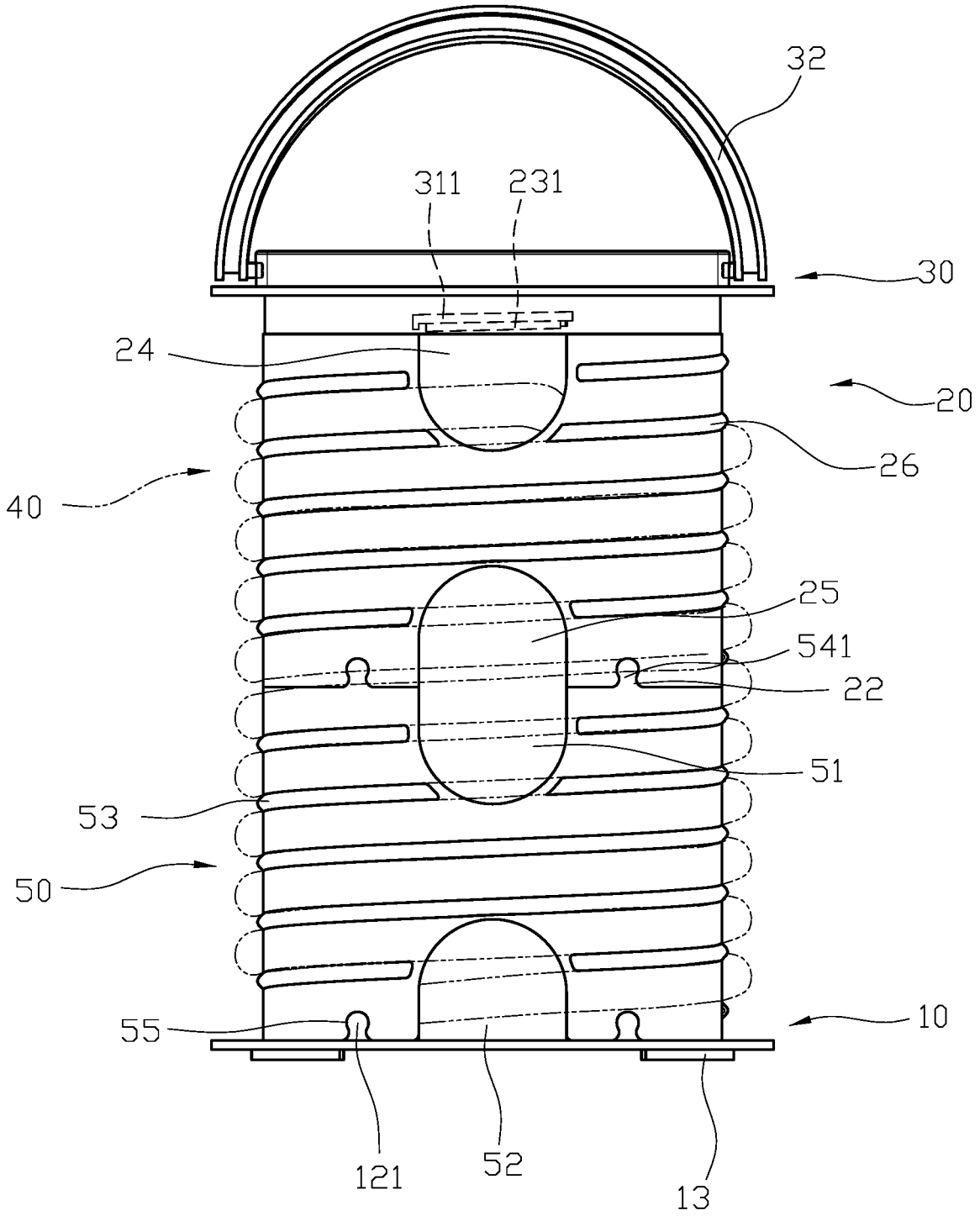
FIG. 9 shows a combination of another embodiment of the present invention and a telescopic hose winding within.

For actual use of the present invention, please refer to FIGS. 3, 4 and 5. When the retractable hose 40 is wound around the outer wall of the cylinder 20, and the retractable hose 40 is more capable of restraining along the limiting rib 26 to surely position the retractable hose 40 around the cylinder 20. Then, two end joints 41 at both ends of the retractable hose 40 pass through the upper and lower opening 24, 25 of the cylinder 20 and are accommodated in the container 21. Therefore, the moisture remaining in the retractable hose 40 flows downwardly spiral winding around the standing cylinder 20 and then is drained from the through aperture 11 of the base 10. A spray head 42 attached to the retractable hose 40 can be hung on the hanging hole 33 of the upper cover 30 or be placed in the container 21, and finally the upper cover 30 covers the top of the assembly portion 23 of the cylinder 20 to store the retractable hose 40. In addition, the handle 32 of the upper cover 30 is configured to facilitate the user to directly carry the structure to enhance the convenience.

Figure 10:
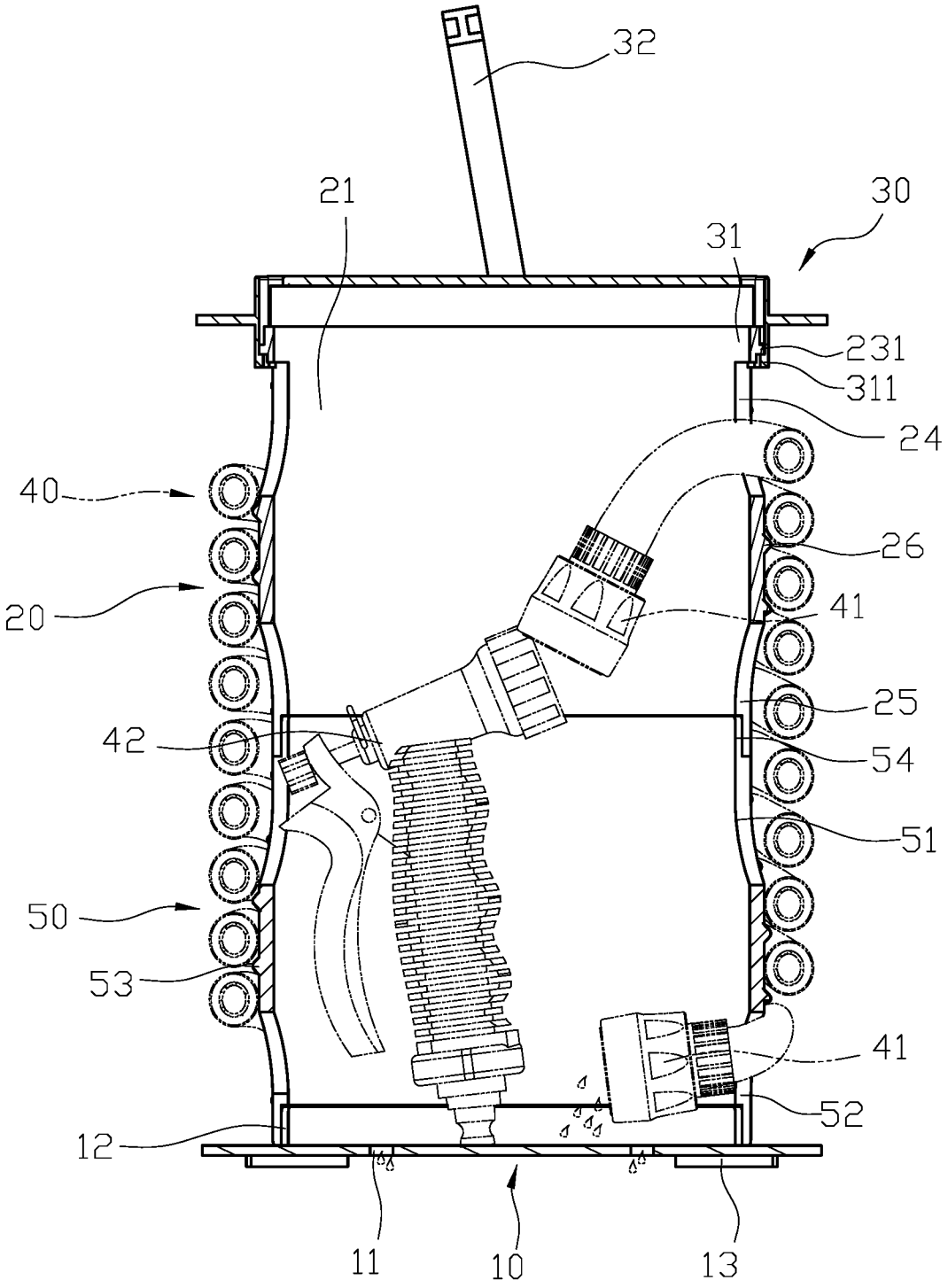
FIG. 10 is a cross-sectional drawing of a practical use state of another embodiment of the present invention.
Figure 11:
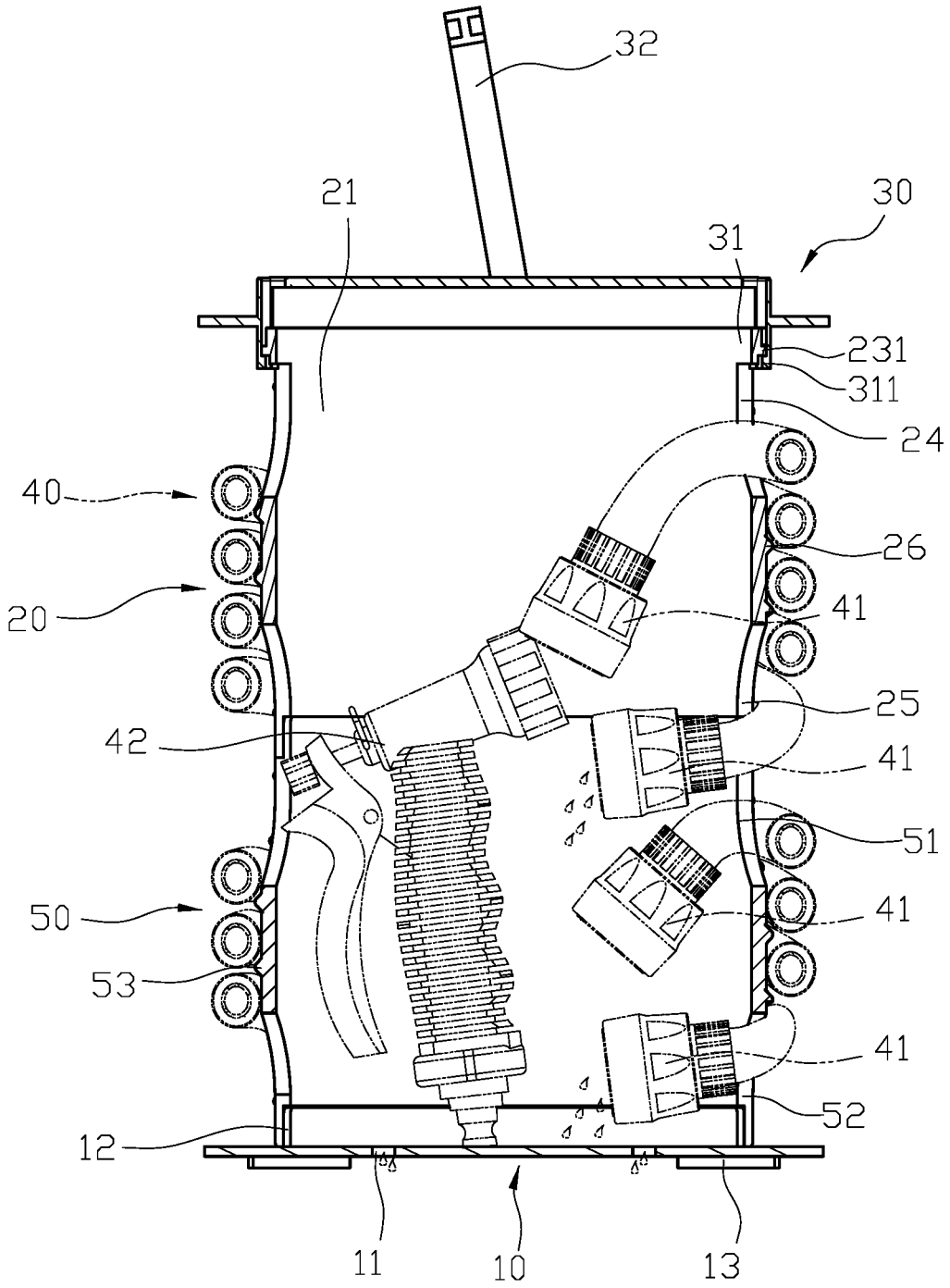
FIG. 11 is a sectional view of another practical use state of another embodiment of the present invention.

Further, the retractable hose storage device can also be additionally provided with at least one external tube 50 between the cylinder 20 and the base 10. As showing in FIGS. 6, 7, 8 and 9, the external tube 50 further has two opposing upper openings 51, two opposing lower openings 52 and circular limiting ribs 53 disposed around its outer sidewall. The external tube 50 is further provided with an assembly portion 54 on its top, and the assembly portion 54 is configured for being mounted at the bottom of the cylinder 20 and has a plurality of second engaging tabs 541 corresponding to the first engaging holes 22. A bottom of the external tube 50 jackets onto the assembling protrusion 12 of the base 10 and has a plurality of second engaging holes 55 corresponding to the first engaging tabs 121 of the assembling protrusion 12. Moreover, a plurality of external tube 50 can be stacked over each other and mounted between the base 10 and the cylinder 20 to increase the height of the retractable hose storage device for a longer retractable hose 40 (as shown in FIG. 10) or for winding and storing a plurality of retractable hoses 40 (as shown in FIG. 11), and the upper openings 51 and the lower openings 52 of the external tube 50 provide access to the joints 41.

With the above specific embodiment, the following benefits can be obtained: The cylinder 20 is disposed between the base 10 and the upper cover 30 for storing the retractable hose 40, and other accessories of the retractable hose 40 such as spray head 42 can also be directly stored in container 21 of the cylinder 20. Secondly, due to the design of the cylinder 20 water will leave the retractable hose 40 to avoid moisture in the retractable hose 40 from damage and rupture, which significantly improves the service life of the retractable hose 40. Furthermore, the retractable hose storage device can also be provided with the external tube 50 depends on the length or number of the retractable hose 40.

Although the present invention has been explained in relation to its preferred embodiment, it is to be understood that many other possible modifications and variations can be made without departing from the spirit and scope of invention as hereinafter claimed.

What is claimed is:

1. A retractable hose storage device comprising:

a base, a cylinder, and an upper cover;

wherein:

the base has a plurality of through apertures and at least one assembling protrusion around the through apertures;

the cylinder has a container perpendicularly jacketed onto the assembling protrusion of the base, and at least one upper opening and one lower opening; and the upper cover has an assembling ring correspondingly disposed with the cylinder, and a plurality of hanging holes.

2. The retractable hose storage device as claimed in claim 1, wherein the assembling protrusion of the base comprises a semi-circular or arced strip and is provided with a plurality of first engaging tabs on an outer surface of the semi-circular or arced strip, a bottom of the cylinder is provided with a plurality of first engaging holes correspondingly engaging with the plurality of first engaging tabs, and a bottom of the base is provided with a plurality of supporting feet.

3. The retractable hose storage device as claimed in claim 1, wherein the assembling protrusion comprises a plurality of symmetrically disposed semi-circular or arced strips.

4. The retractable hose storage device as claimed in claim 1, wherein the cylinder further comprises two opposing upper openings and two opposing lower openings, and circular limiting ribs are disposed around an outer sidewall of the cylinder.

5. The retractable hose storage device as claimed in claim 1, wherein the cylinder is further provided with an assembly portion on a top thereof, the assembly portion having at least two positioning grooves, the assembling ring of the upper cover having two opposing positioning ribs for correspondingly engaging with the positioning groove, and the upper cover has a handle.

6. A retractable hose storage device comprising:

a base, a cylinder, an upper cover, and at least one external tube;

wherein:

the base has a plurality of through apertures and at least one assembling protrusion around the through apertures;

the cylinder has a container perpendicularly jacketed onto a top of the external tube, and at least one upper opening and one lower opening;

the upper cover has an assembling ring correspondingly disposed with the cylinder, and a plurality of hanging holes; and a bottom of the at least one external tube is jacketed onto the assembling protrusion of the base.

7. The retractable hose storage device as claimed in claim 6, wherein the cylinder further comprises two opposing upper openings and two opposing lower openings and circular limiting ribs disposed around an outer sidewall of the cylinder.

8. The retractable hose storage device as claimed in claim 6, wherein the cylinder is further provided with an assembly portion on a top thereof, the assembly portion has at least two positioning grooves, the assembling ring of the upper cover having two opposing positioning ribs for correspondingly engaging with the positioning groove, and the upper cover has a handle.

9. The retractable hose storage device as claimed in claim 6, wherein the assembling protrusion of the base comprises a semi-circular or arced strip and is provided with a plurality of first engaging tabs on an outer surface of the semi-circular or arced strip, a bottom of the external tube is provided with a plurality of first engaging holes correspondingly engaging with the plurality of first engaging tabs, and a bottom of the base is provided with a plurality of supporting feet.

10. The retractable hose storage device as claimed in claim 9, wherein assembling protrusion of the base comprises a plurality of evenly disposed semi-circular or arced strips.

11. The retractable hose storage device as claimed in claim 10, wherein the external tube further comprises two opposing upper openings and two opposing lower openings and circular limiting ribs disposed around an outer sidewall of the external tube; the external tube is further provided with an assembly portion on the top thereof, the assembly portion configured for being mounted on a bottom of the cylinder and having a plurality of second engaging tabs corresponding to the first engaging holes, and the bottom of the external tube jackets onto the assembling protrusion of the base and has a plurality of second engaging holes corresponding to the first engaging tabs of the assembling protrusion.

12. The retractable hose storage device as claimed in claim 9, wherein the external tube further comprises two opposing upper openings, two opposing lower openings and circular limiting ribs disposed around an outer sidewall of the external tube; the external tube is further provided with an assembly portion on the top thereof, the assembly portion configured for being mounted on a bottom of the cylinder and having a plurality of second engaging tabs corresponding to the first engaging holes, and the bottom of the external tube jackets onto the assembling protrusion of the base and has a plurality of second engaging holes corresponding to the first engaging tabs of the assembling protrusion.

* * * * *